United States Patent [19]

Nakamura et al.

[11] Patent Number: 4,652,705

[45] Date of Patent: Mar. 24, 1987

[54] IGNITION DISTRIBUTOR WITH NOISE SUPPRESSION ELECTRODE OXIDE COATING

[75] Inventors: Naotaka Nakamura, Chita; Yoshimi Miyamoto, Toyota; Motokazu Momiyama, Okazaki; Toshiji Tsubai, deceased, late of Gifu, Japan, by Miki Tsubai, legal representative; Tatsuo Teratani; Nobuyuki Ishihara, both of Toyota, all of Japan

[73] Assignees: Nippondenso Co., Ltd., Kariya; Toyota Jodosha Kabushiki Kaisha, Toyota, both of Japan

[21] Appl. No.: 767,361

[22] Filed: Aug. 20, 1985

[30] Foreign Application Priority Data

Aug. 22, 1984 [JP] Japan ..... 59-175459

[51] Int. Cl.[4] ..... F02P 7/02; H01H 1/00; H01H 19/00

[52] U.S. Cl. ..... 200/19 R; 123/633; 200/19 DR; 200/19 DC; 200/267; 200/268

[58] Field of Search ..... 200/19 R, 19 DC, 19 DR, 200/262–270, 237–239; 123/146.5 A, 633

[56] References Cited

U.S. PATENT DOCUMENTS 3,992,230 11/1976 Komiyama et al. ..... 148/6.3
4,007,342 2/1977 Makino et al. ..... 200/19 R
4,091,245 5/1978 Komiyama et al. ..... 200/268 X
4,165,452 8/1979 Olander et al. ..... 200/19 DR
4,175,144 11/1979 Hori et al. ..... 427/126

FOREIGN PATENT DOCUMENTS 1092187 12/1980 Canada .

OTHER PUBLICATIONS

Japanese Patent Unexamined Publication No. 87859/80; 7/1980.

*Primary Examiner*—J. R. Scott
*Attorney, Agent, or Firm*—Cushman, Darby & Cushman

[57] ABSTRACT

An ignition distributor having a radio wave noise suppressing function has a rotor electrode and counter electrodes. At least the cathodic one of the rotor electrode and the counter electrodes is provided at its end with a coating layer of a material which is a mixture of a metal oxide having a high electric resistance and a metal oxide which constitutes a dielectric body stable in a high-temperature atmosphere. The metal oxide having high electric resistance consists essentially of 10 to 50 wt % of $Cu_2O$ and 90 to 50 wt % of CuO, while the metal oxide constituting the dielectric body essentially consists of 70 to 90 wt % of alumina with respect to the weight of the metal oxide having high electric resistance.

4 Claims, 6 Drawing Figures

IGNITION DISTRIBUTOR WITH NOISE SUPPRESSION ELECTRODE OXIDE COATING

BACKGROUND OF THE INVENTION

The present invention relates to a device for suppressing generation of radio wave noise from ignition systems and, more particularly, to a radio-wave-noise suppression distributor used in an ignition system for internal combustion engine, in which distributor radio wave noise caused from the rotor electrode and the counter electrodes of the distributor is minimized.

Hitherto, an ignition distributor has been proposed in which a high-resistance layer is formed by plasma spraying process on the end of the rotor electrode for the purpose of reducing the radio wave noises. This type of the distributor rotor is generally referred to as "plasma-spray-coated rotor".

More specifically, in this plasma-spray-coated rotor, a layer of high-resistance electrode is formed on at least one of the discharge electrode on the rotor and the discharge electrodes of the counter electrodes as disclosed in U.S. Pat. No. 4,007,342. The high-resistance layer is formed, as proposed in U.S. Pat. No. 3,992,230, by spraying a metal oxide having a high electric resistance, e.g., CuO, onto the discharge electrode by means of plasma.

The ignition distributor having the sprayed electrode provided with the CuO layer, however, suffers from a disadvantage in that CuO constituting the high-resistance layer is reduced to $Cu_2O$ when used in the atmosphere of high temperature, resulting in a reduced electric resistance of the high-resistance layer, so that the noise reducing effect of the layer is lost. In order to overcome this problem, it has been proposed to add a metal oxide which is stable even in the atmosphere of high temperature, e.g., $Al_2O_3$, $SiO_2$, to the material of the high-resistance layer. Such a countermeasure is disclosed, for example, in U.S. Pat. No. 4,175,144.

A distributor has been proposed also in which a layer of a composite material of a mixture of a metal such as Cu and a metal oxide such as $Al_2O_3$ is formed on the end of the electrode, as shown, for example, in Japanese Laid-Open Patent Publication No. 87859/1980. This type of distributor, however, does not have sufficient effect of suppression of radio wave noise, although it can lower the discharge starting voltage. In addition, this type of distributor is impractical in that it is difficult to produce. In addition, the effect of lowering the discharge starting voltage could not be obtained stably because the layer formed on the electrode cannot have stable grain boundary structure, unlike the plasma-spray-coated rotor.

On the other hand, there is a trend for smaller height of the bonnet of motor vehicles due to an increasing demand for front-engine front-wheel driving type vehicles, as well as for higher aerodynamic performance. This in turn requires the clearance between the distributor and the bonnet to be reduced, causing a tendency of higher level of radio wave noises from the distributor. Under this circumstance, there is an increasing demand for higher noise prevention effect of plasma-spray-coated rotors.

SUMMARY OF THE INVENTION

Accordingly, it is a primary object of the invention to further improve the noise prevention effect of the plasma-spray-coated rotor, by suitably selecting the kind of the copper oxide to be sprayed, as well as the ratio of mixing of alumina with the copper oxide.

To this end, according to the invention, there is provided an ignition distributor having a radio wave noise suppressing function having a rotor electrode and counter electrodes, characterized in that at least the cathodic one of both the rotor electrode and the counter electrodes is provided at its end with a coating layer of a material which is a mixture of a metal oxide having a high electric resistance and another metal oxide which constitute a dielectric body stable in a high-temperature atmosphere, the metal oxide having high electric resistance consisting essentially of 10 to 50 wt % of $Cu_2O$ and 90 to 50 wt % of CuO, the metal oxide constituting the dielectric body essentially consisting of 70 to 90 wt % of alumina with respect to the weight of the mixture described above.

The coating layer is formed preferably by plasma-spraying method.

DESCRIPTION OF THE PREFERRED EMBODIMENTS

In a conventional plasma-spray-coated rotor, the coating layer is formed by spraying a material which is a mixture of copper oxide (cuprous oxide) containing about 100 wt % of CuO, and 30 wt % of alumina regarding the CuO. The present inventors have conducted various experiments in order to seek for composition which would provide higher noise suppression effect.

As is well known to those skilled in the art, the strength or level of the radio wave noise depends on the level of the voltage at which the discharge is started. Namely, the level of the radio wave noise can be reduced by lowering the discharge starting voltage.

Figure 5:
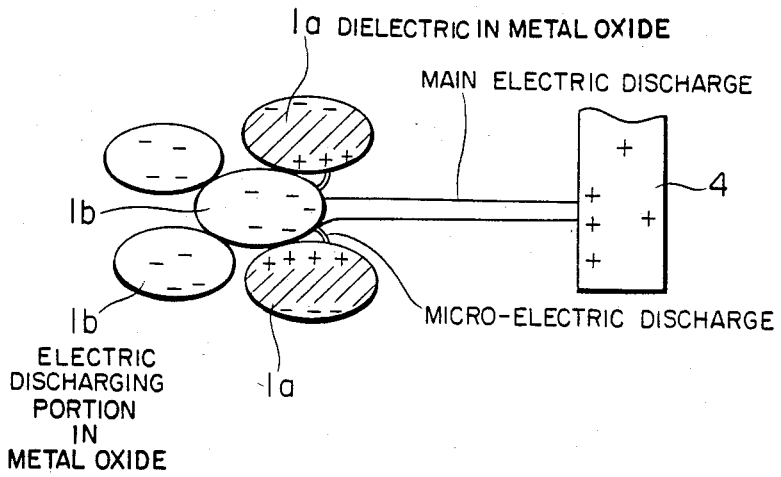
FIG. 5 is a schematic illustration of the distributor of the invention, explanatory of the advantage of the invention.

The lowering of the discharge starting voltage can be attained, for example, by adopting the following arrangement. Namely, as shown in FIG. 5, a multiplicity of dielectric bodies 1*a* (in metal oxide) are arranged around the discharging portion of the cathode, such that minute discharges take place between the discharging portion 1*b* (also in metal oxide) and the dielectric charges on the dielectric bodies 1*a*, when the discharge voltage is applied. According to this arrangement, the number of electrons around the cathode is increased so that the discharge between the cathode and the anode 4 can be started at a lower voltage. This effect is generally known as "Marter effect".

Considering that the discharge starting voltage in the conventional plasma-spray-coated rotor is as high as 3.5 to 7 KV when the discharge gap is 1 mm, the present inventors attempted to lower the discharge starting voltage by making an effective use of the Marter effect. More specifically, the inventors attempted to increase the number of the dielectric bodies by increasing the alumina content in the coating material. An increased alumina content, however, increases the resistance value of the sprayed layer with the result that there is caused such disadvantage as the loss of the sparking energy. Therefore, the inventors used, as the copper oxide, a material essentially consisting of 10 to 50 wt % of cupric oxide ($Cu_2O$) and 90 to 50 wt % of cuprous oxide (CuO), which material having such specific ranges and exhibiting a lower electric resistance than the conventional copper oxide used in the prior art is formed by the usual oxidation of copper.

Figure 4:
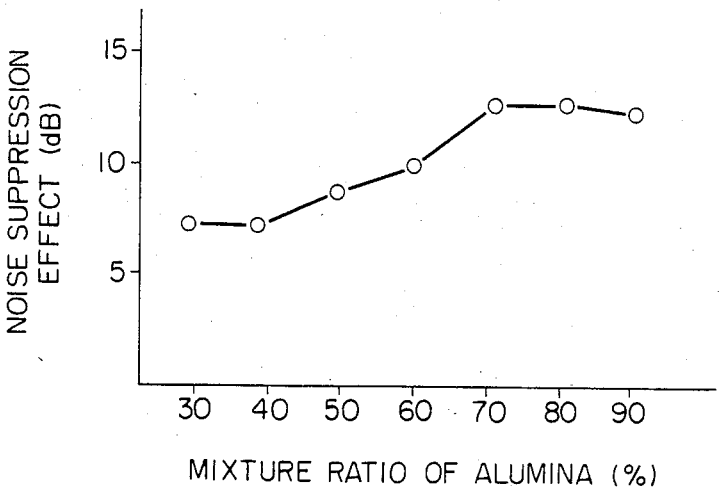
FIG. 4 is a graph showing the relationship between the alumina mixing ratio and the noise prevention effect, explanatory of the advantage of the invention.

FIG. 4 shows the result of a test plasmaspray coating which was conducted while varying the alumina content in the mixture of the copper oxide mentioned above and the alumina. As expected by the inventors, a higher noise suppression effect was produced by increasing the alumina content. In fact, it was confirmed that the noise level can be reduced by about 5 dB by selecting the alumina content to have a range between 70 and 90% regarding the total weight of the mixture.

Figure 2:
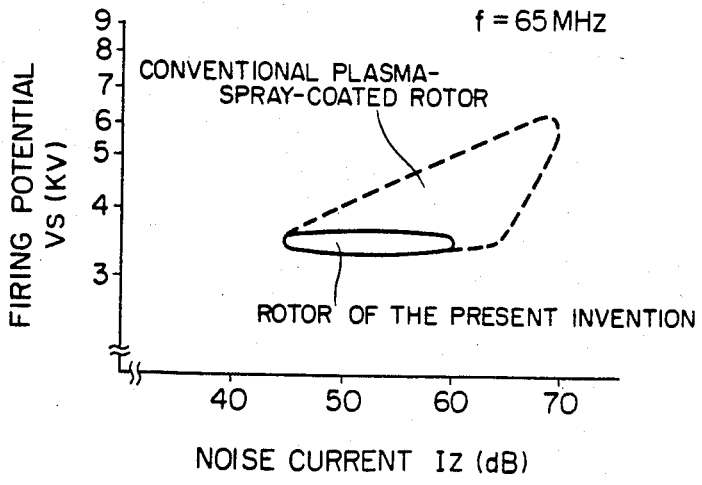
FIG. 2 is a graph showing the relationship between the noise current and discharge starting voltage as observed in the distributor of the invention and a conventional distributor.

Another test was conducted to measure simultaneously both the discharge starting voltage Vs and the noise current Iz interrelated to the intensity of the noise by use of 15,000 time of sparking caused regarding each of the conventional plasma-spray-coated rotor and the rotor in accordance with the invention. As will be seen from FIG. 2 showing the result of this test, the rotor in accordance with the invention showed a stable discharge starting voltage which was as low as about 3.5 KV, while the conventional plasma-spray-coated rotor exhibited discharge starting voltage which was fluctuated over a wide range between 3.5 and 7 KV. This shows that the rotor in accordance with the invention provides a higher noise suppressing effect than the conventional one. It was also confirmed that the rotor in accordance with the invention permits a good sparking without substantial loss of the sparking energy.

Although experiments were conducted by using various substitutive materials such as $MgO.Al_2O_3$, $SiO_2$ and so forth in place of alumina ($Al_2O_3$), the rotors having coating layers containing such substitutive materials could not show any remarkable effect: namely, the discharge starting voltage was fluctuated between 3.5 and 6 KV in each case.

Although not theoretically clarified yet, the advantageous effect produced by the invention may be attributed to a fact that the dielectric constant of the alumina and the grain boundary structure between alumina and CuO ($+Cu_2O$) after the spray coating produce a certain effect on the discharge starting voltage in such a way to lower the level of the discharge starting voltage by virture of the Marter effect.

Figure 3:
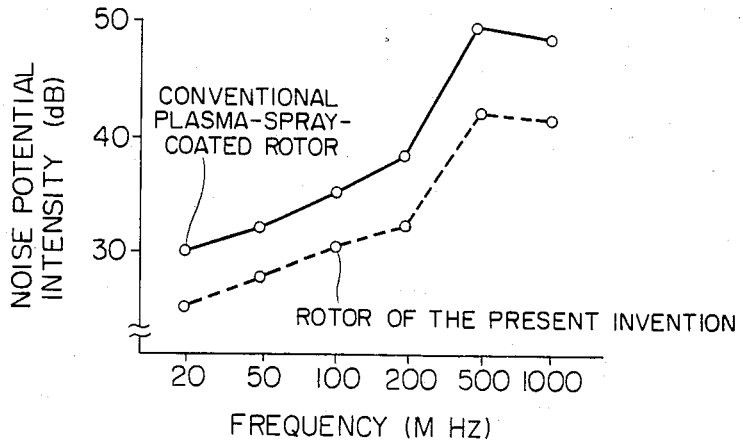
FIG. 3 is a graph showing the relationship between the frequency and noise potential intensity as observed in the distributor of the invention.

As has been described, in the distributor of the invention, the rotor has both the high electric resistance peculiar to the plasma-spray-coated rotor and high stability in the high-temperature atmosphere derived from the addition of alumina. In addition, the rotor in the distributor of the invention shows a lower discharge starting voltage than the conventional rotor. In consequence, the rotor in the distributor of the invention affords a noise suppression effect in the degree of 5 to 10 dB as compared with the conventional rotor, as will be seen from FIG. 3.

Furthermore, considering that the preparation of pure CuO requires a complicated process including the steps of oxidizing copper powder into $CuO+Cu_2O$ and further oxidizing the $CuO+Cu_2O$, the distributor of the invention having a rotor coated by a material containing $CuO+Cu_2O$ in place of CuO can be produced easily at a lower cost than the distributor having known plasma-spray-coated rotor.

As has been described, the distributor in accordance with the invention exhibits a higher noise suppression effect by virture of both the known effect of attenuation of the noise current flowing through the high resistance layer and the reduction and stabilization of the discharge starting voltage which is attributable to the specific grain boundary structure obtained after the plasma spraying. In addition, the rotor in accordance with the invention can be produced without substantial difficulty by the plasma spraying technique which has been established already, so that the invention can be carried out easily while the advantages thereof explained hereinabove can be obtained stably.

The advantages produced by the invention will be more fully realized from the following description of practical embodiments.

Figure 1:
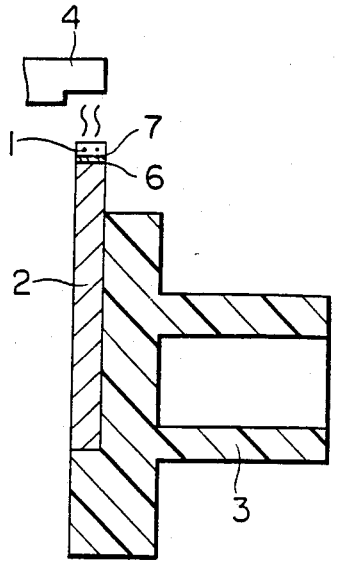
FIG. 1 is a vertical sectional view of an essential portion of a distributor in accordance with the invention.

Referring to FIG. 1, a short blast of a grinding material such as fired alumina is conducted for 5 minutes on a brass rotor electrode 2 of the rotor 3 of an ignition distributor rotor 3, thereby grinding and cleaning the end 6 of the rotor electrode 2. Subsequently, the rotor electrode 2 is preheated up to 50° to 100° C., and the nickel aluminide is sprayed within a hot plasma, thus forming an intermediate layer 7 of 0.05 to 0.1 mm on the end of the rotor electrode 2.

Meanwhile, a mixture is formed from copper oxide and alumina. More specifically, the copper oxide used is such one as obtained ordinarily by oxidizing powdered copper, usually containing 10 to 50% of $Cu_2O$ and 90 to 50% of CuO and having a mean grain size ranging between −150 and 325 mesh. The mixture is prepared by adding 70 to 90 wt % of alumina of 325 to 1250 mesh to the copper oxide mentioned above, and mixing the copper oxide and the alumina together for about 1 hour in a rotary mixer operating at 40 to 45 rpm. The thus obtained mixture was sprayed within a high-temperature plasma such as to form a coating layer 1 of 0.2 to 0.6 mm thick on the end of the rotor electrode 2 onto which end a nickel-aluminide layer was previously provided by plasma spray with a current of 500 A and voltage of 70 V. A reference numeral 4 designates a counter electrode adjacent the distributor cap. The plasma spray of the mixture is effected in an atmosphere of $N_2+H_2$ with arc current of 400 A and voltage of 70 V.

Figure 6:
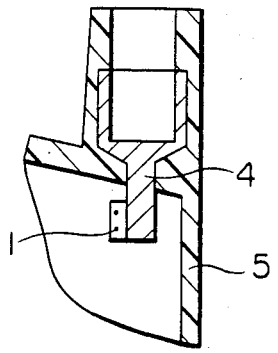
FIG. 6 is a vertical sectional view of an essential portion of another embodiment of the distributor in accordance with the invention.

FIG. 6 shows another embodiment of the invention, in which a coating layer 1 of 0.2 to 0.6 mm thick similar to that formed in the first embodiment is formed on the discharging end of the counter electrode 4. The formation of the coating layer 1 is conducted substantially in the same manner as that in the first embodiment, so that the description is omitted in this regard.

Although the invention has been described through specific terms, it is to be noted that the described embodiments are only illustrative and various changes and modifications may be imparted thereto without departing from the scope of the invention which is limited solely by the appended claims.

What is claimed is:

1. An ignition distributor having a radio wave noise suppression function, comprising: a rotor electrode and counter electrodes, at least a cathodic one of said rotor electrode and each of said counter electrodes being provided at a respective end thereof with a coating layer of a material which is a mixture consisting essentially of one metal oxide having a high electric resistance and another metal oxide which constitutes a dielectric body which is stable in a high-temperature atmosphere, said one metal oxide having high electrice resistance consisting essentially of 10 to 50 wt % of $Cu_2O$ and 90 to 50 wt % of CuO, and said other metal oxide constituting the dielectric body consisting essentially of 70 to 90 wt % of alumina with respect to the weight of said mixture.

2. An ignition distributor having a radio wave noise suppressing function according to claim 1, wherein said coating layer has a thickness which ranges between 0.2 and 0.6 mm.

3. An ignition distributor having a radio wave noise suppressing function according to claim 1, wherein a nickel aluminide layer of 0.05 to 0.1 mm thick is formed between the material of the electrode and said coating layer.

4. An ignition distributor having a radio wave noise suppressing function according to claim 1, wherein said coating layer is formed by spraying a mixture of copper oxide of −150 to 325 mesh and alumina by means of a plasma.

* * * * *